US010259604B2

(12) United States Patent
Myers

(10) Patent No.: US 10,259,604 B2
(45) Date of Patent: Apr. 16, 2019

(54) COMPOUND TENSION AND CALIBRATION MECHANISM FOR CABLE TIE TENSIONING AND CUT-OFF TOOL

(71) Applicant: HellermannTyton Corporation, Milwaukee, WI (US)

(72) Inventor: Travis J. Myers, Milwaukee, WI (US)

(73) Assignee: HELLERMANNTYTON CORPORATION, Milwaukee, WI (US)

( * ) Notice: Subject to any disclaimer, the term of this patent is extended or adjusted under 35 U.S.C. 154(b) by 607 days.

(21) Appl. No.: 14/966,969

(22) Filed: Dec. 11, 2015

(65) Prior Publication Data

US 2016/0167813 A1 Jun. 16, 2016

Related U.S. Application Data

(60) Provisional application No. 62/091,004, filed on Dec. 12, 2014.

(51) Int. Cl.

| | |
|---|---|
| ***B25B 25/00*** | (2006.01) |
| ***B65B 13/22*** | (2006.01) |
| ***B65B 13/02*** | (2006.01) |

(52) U.S. Cl.

CPC ..... *B65B 13/22* (2013.01); *B25B 25/00* (2013.01); *B65B 13/027* (2013.01)

(58) Field of Classification Search

CPC ..... B25B 25/00; B65B 13/025; B65B 13/027; B65B 13/22

See application file for complete search history.

(56) References Cited

U.S. PATENT DOCUMENTS

| | | | | |
|---|---|---|---|---|
| 3,433,275 | A | 3/1969 | Eppler | |
| 3,531,822 | A | 10/1970 | Bush | |
| 3,633,633 | A | 1/1972 | Countryman | |
| 3,712,346 | A | 1/1973 | Noorily | |
| 3,735,784 | A | 5/1973 | Obuch et al. | |
| 3,782,426 | A * | 1/1974 | Morgan | B21F 9/02 140/123.6 |
| 3,853,155 | A | 12/1974 | Kabel | |
| 3,865,156 | A | 2/1975 | Moody et al. | |
| 3,986,634 | A | 10/1976 | Smith et al. | |
| 4,047,545 | A * | 9/1977 | Paradis | B65B 13/027 140/123.6 |
| 4,091,955 | A | 5/1978 | Sloan, Sr. | |

(Continued)

FOREIGN PATENT DOCUMENTS

| | | |
|---|---|---|
| CA | 143621 | 8/2012 |
| CN | ZL201130506376.7 | 8/2012 |

(Continued)

OTHER PUBLICATIONS

International Search Report relating to PCT/US2015/065364, dated Feb. 16, 2016, 8 pages.

*Primary Examiner* — Emmanuel M Marcelo
(74) *Attorney, Agent, or Firm* — Robert J. Myers

(57) ABSTRACT

A hand held tool for the tensioning and severing of cable ties, including reciprocating means for tensioning the cable tie tail, locking means to prevent further tensioning upon the attainment of a preselected tension level in the tie tail, and severing means to sever the tie tail from the cable tie head. The tool includes a tension adjustment system and an independent calibration mechanism.

19 Claims, 9 Drawing Sheets

(56) References Cited

U.S. PATENT DOCUMENTS 4,093,005 A 6/1978 Blackburn et al.
4,142,648 A 3/1979 Johnson et al.
RE29,973 E 4/1979 Paradis
4,165,816 A 8/1979 Tupper
4,168,012 A 9/1979 Hawkinson
4,192,358 A 3/1980 Bone
4,299,102 A 11/1981 Aro
RE30,996 E 7/1982 Pobuta et al.
4,390,047 A 6/1983 Kaneko
D273,361 S 4/1984 Suzuki
4,494,673 A 1/1985 Hiraishi
4,548,242 A 10/1985 Paradais
D281,301 S 11/1985 Spolar
4,718,460 A 1/1988 Sato
4,793,385 A 12/1988 Dyer et al.
D305,977 S 2/1990 Ono
4,908,911 A 3/1990 Bretti et al.
4,934,416 A 6/1990 Tonkiss
4,947,901 A 8/1990 Rancour et al.
4,993,669 A 2/1991 Dyer
4,997,011 A 3/1991 Dyer et al.
5,031,790 A 7/1991 Keller
5,048,575 A * 9/1991 Smith ..... B65B 13/027 140/123.6
5,102,075 A 4/1992 Dyer
5,110,003 A 5/1992 Kimbara
5,183,173 A 2/1993 Heckman
5,205,328 A 4/1993 Johnson et al.
5,320,129 A 6/1994 Bosio
5,416,955 A 5/1995 Katsma
5,417,254 A 5/1995 Kurmis
5,449,086 A 9/1995 Harris
D363,212 S 10/1995 Hill
5,492,156 A * 2/1996 Dyer ..... B21F 9/02 140/123.6
D368,853 S 4/1996 Liu et al.
5,595,220 A 1/1997 Leban et al.
5,628,348 A 5/1997 Scott et al.
5,638,975 A 6/1997 Harris
5,647,407 A 7/1997 Scott et al.
5,720,328 A 2/1998 Ott
5,769,133 A 6/1998 Dyer et al.
5,820,083 A 10/1998 Geiger
5,832,964 A 11/1998 Joshi
5,843,964 A 12/1998 Boss
5,845,681 A 12/1998 Kurmis
5,853,524 A 12/1998 Nix
5,884,367 A 3/1999 Teagno et al.
5,909,751 A 6/1999 Teagno
5,915,425 A * 6/1999 Nilsson ..... B65B 13/027 140/123.6
5,921,290 A * 7/1999 Dyer ..... B65B 13/027 140/123.6
5,944,063 A 8/1999 Kurmis
5,966,781 A 10/1999 Geiger
6,035,906 A 3/2000 Ott
D424,923 S 5/2000 Lodi
6,079,582 A 6/2000 Nicke et al.
6,105,908 A 8/2000 Kraus
6,173,855 B1 1/2001 Stark
6,179,148 B1 1/2001 Harris
6,196,033 B1 3/2001 Dowdle
6,202,706 B1 3/2001 Leban
6,202,879 B1 3/2001 Gericke
6,206,053 B1 * 3/2001 Hillegonds ..... B65B 13/027 140/123.6
D442,851 S 5/2001 Wilson
6,240,602 B1 6/2001 Geiger
6,279,620 B1 8/2001 Eason et al.
6,302,157 B1 10/2001 Deschenes et al.
6,308,852 B1 10/2001 Hagano
6,325,233 B1 12/2001 Harris
6,332,553 B1 12/2001 Yamada et al.
6,363,244 B1 3/2002 McGhee
6,457,492 B1 10/2002 Kuhn et al.
6,497,258 B1 12/2002 Flannery et al.
6,513,555 B1 2/2003 Lesser et al.
6,568,553 B2 5/2003 Hagano et al.
D491,430 S 6/2004 Magno, Jr. et al.
6,745,914 B2 6/2004 Hagano et al.
6,763,966 B2 7/2004 Harris
6,793,091 B2 9/2004 Hagano et al.
6,814,251 B2 11/2004 Hagano
6,828,509 B2 12/2004 Ito et al.
6,840,289 B2 1/2005 Hillegonds
6,902,079 B2 6/2005 Hagano
6,913,162 B2 7/2005 Hagano et al.
D510,244 S 10/2005 Magno, Jr. et al.
6,997,339 B2 2/2006 Ueki
7,025,222 B2 4/2006 Hagano et al.
7,048,138 B2 5/2006 Hagano et al.
7,086,426 B2 8/2006 Magno, Jr.
7,124,787 B2 10/2006 Lueschen
D537,333 S 2/2007 Jowsey
7,185,680 B2 3/2007 Magno, Jr.
D541,142 S 4/2007 Geiger
7,216,679 B2 5/2007 Magno, Jr. et al.
D543,811 S 6/2007 Lueschen
7,231,944 B2 6/2007 Magno, Jr. et al.
D547,626 S 7/2007 Lueschen
7,290,673 B2 11/2007 Hagano
7,299,830 B2 11/2007 Levin et al.
7,344,042 B2 3/2008 Hagano
D565,401 S 4/2008 Grady et al.
D570,673 S 6/2008 Geiger et al.
7,422,037 B2 9/2008 Levin et al.
7,437,804 B1 10/2008 Geiger et al.
7,484,636 B2 2/2009 Yoshida et al.
7,487,879 B2 2/2009 Yoshida et al.
7,493,925 B2 2/2009 Bae
7,520,401 B2 4/2009 Scharrer
7,588,159 B2 9/2009 Otsuka
7,591,451 B2 9/2009 Dyer et al.
7,748,415 B2 7/2010 Barlosov et al.
7,753,321 B2 7/2010 Geiger
7,774,905 B2 8/2010 Geiger
7,784,634 B2 8/2010 Yoshida
D631,731 S 2/2011 Chen
7,877,841 B2 2/2011 Mangaroo et al.
D634,187 S 3/2011 Kozel
8,033,966 B2 10/2011 Ayoub
8,051,881 B2 11/2011 Segroves
8,074,334 B2 12/2011 Tharp
D670,154 S 11/2012 Kelleghan
D692,738 S 11/2013 Dyer
8,955,556 B2 2/2015 Dyer et al.
8,960,241 B2 2/2015 Dyer et al.
D723,361 S 3/2015 Adams
D732,361 S 6/2015 Dyer
D739,714 S 9/2015 Geiger et al.
2003/0106190 A1 6/2003 Christianson
2004/0079436 A1 * 4/2004 Hillegonds ..... B65B 13/027 140/123.6
2004/0262312 A1 12/2004 Hagano
2005/0115629 A1 * 6/2005 Bernard ..... B65B 13/027 140/123.5
2007/0045322 A1 3/2007 Hagano
2008/0092981 A1 * 4/2008 Hillegonds ..... B21F 9/02 140/93.4
2008/0185409 A1 8/2008 Kennenberger
2009/0121069 A1 5/2009 Dyer et al.
2009/0223959 A1 9/2009 Schulz
2009/0276983 A1 11/2009 Chan
2010/0071169 A1 3/2010 Williams et al.
2010/0089919 A1 4/2010 Dunkle
2010/0306967 A1 12/2010 Geiger
2012/0291231 A1 11/2012 Ku

(56) References Cited

U.S. PATENT DOCUMENTS

| | | | | |
|---|---|---|---|---|
| 2013/0167969 | A1 | 7/2013 | Myers et al. | |
| 2016/0230907 | A1 * | 8/2016 | Kitago ..... | B65D 63/04 |

FOREIGN PATENT DOCUMENTS

| | | | |
|---|---|---|---|
| DE | 402011006850.8 | | 10/2013 |
| EP | 839717 | | 5/1998 |
| EP | 1108649 | | 6/2001 |
| ES | 513904 | | 2/2012 |
| FI | 25152 | | 5/2012 |
| GB | 1577957 | | 10/1980 |
| GB | 4022903 | | 3/2012 |
| IT | 0000100862 | | 2/2014 |
| JP | 1456198 | | 10/2012 |
| MX | 38043 | | 2/2013 |
| NO | 83385 | | 2/2012 |
| PL | RP-18518 | | 4/2012 |
| SE | 82008 | | 8/2012 |
| SG | 2011/1547 | C | 12/2011 |
| WO | WO 98/45063 | A1 | 10/1998 |
| WO | WO2013003471 | A1 | 1/2013 |

* cited by examiner

COMPOUND TENSION AND CALIBRATION MECHANISM FOR CABLE TIE TENSIONING AND CUT-OFF TOOL

RELATED APPLICATION

This application claims the benefit of U.S. Provisional Patent Application Ser. No. 62/091,004, filed 12 Dec. 2014.

BACKGROUND OF THE INVENTION

The present invention relates to hand held tensioning and cutting tools, and particularly to an improved hand tool for tensioning and cutting cable ties.

Cable ties are widely used in a variety of environments and applications. They may be used, for example, to bundle a plurality of elongate wires, cables, or other elongate articles. Cable ties may also be used to secure elongate articles to rigid structures or used as hose clamps, by way of example. Such cable ties typically include an elongate tail portion which is threaded through an integral head portion to encircle the articles to be bound and the tie tail is drawn through the cable tie head to tightly bind the elongate articles into a bundle. After the tie is tensioned around the bundle, the excess length of the tie tail which extends out of the head portion is then severed by the tool close to the head. Ties are often applied in high volumes and to precise tensions.

One disadvantage of many presently available tie tensioning and severing tools is that those tools require an operator to apply an excessive force on their triggers which leads tool operator fatigue after only a relatively small number of cables ties have been installed by the operator. Additionally, many prior art tie tensioning and severing tools have their tool triggers mechanically linked to the tensioning and severing mechanisms in a manner that the actual tension attained in the cable tie immediately prior to severing of the cable tie tail varies with the position of the operator's grip on the trigger during operation of the tool. Tools which rely upon mechanical linkages often increase the tension in the cable tie above the preselected value immediately prior to severing due to the movement of the linkages during the tensioning operation. This can cause stretching, weakening or breakage of the tie during severing.

The present invention has application to the cable tie tensioning and cut-off tools disclosed in U.S. patent application Ser. Nos. 13/534,791; 13/534,826; 13/534,877; 13/534,902; 14/532,619 and 14/532,637 owned by the same assignee and each incorporated herein by reference.

SUMMARY OF THE INVENTION

The present invention is directed to a hand-held tensioning and severing tool which avoids the aforementioned shortcomings.

In accordance with a principal aspect of the present invention, a selective tension adjustment system is provided in the form of an acme thread cam and knob for selectively changing the preselected tie tension to a selected tension value.

Another object of the present invention is to provide a hand tool for tensioning and severing cable ties which includes rotatable selective tension adjustment means for rapidly and reliably selecting a number of preselected tension levels.

An embodiment of the invention comprises a tensioning system for adjusting the tension imparted to a cable tie in a cable tie tensioning and cut-off tool, the cut off tool including a housing and a cable tie gripping mechanism, the tensioning system having a tension adjustment knob having at least one slot formed thereon and at least one spline formed therein; a ring member having at least one cog on a first side and at least one detent on a second side, the at least one cog being engagable with the at least one slot; a rotating cam having an external thread and at least one tessellated portion formed thereon, the at least one tessellated portion being engagable with the at least one spline; a fixed cam coupled to the housing and having an internal thread being engagable with the rotating cam external thread; a tension shaft having a first end, the first end being coupled to the rotating cam; and at least one tension biasing member coupled to the shaft and to the gripping mechanism.

The tensioning system may further include a locking latch coupled to the housing and having at least one tooth engagable with the at least one detent and a protrusion affixed to the fixed cam, the protrusion being engagable with the at least one detent formed on the ring member. When engaged the locking latch prevents a disengagement of the at least one tooth and detent.

The tensioning system further includes a calibration mechanism, the calibration mechanism having a thread being formed on a first end of the tension shaft and a calibration nut being located between the rotating cam and the tension adjustment knob, the nut including a threaded opening for receiving the first end of the tension shaft. The tension biasing member may comprise a spring, two springs or a plurality of springs.

The tensioning system may further include a calibration tool having a working end. The calibration nut may have at least one slot formed therein whereby the calibration tool working end may be engaged with the at least one calibration nut slot. In another embodiment, the tension adjustment knob has an opening formed therein and further includes a removable cap covering the opening. In addition a plurality of ridges may be formed on the calibration nut, the ridges being engagable with groves formed on the rotating cam. In another embodiment, the tension adjustment knob has a recessed opening and the tension calibration nut is accessible through the opening.

Indicia may be formed on or applied to the tension adjustment knob; the indicia correspond to incremental tension ranges and designated tension settings for the system. In addition the at least one detent and the at least one protrusion may provide a tactile indication of tension adjustment as the knob is rotated. Alternatively or concurrently, the at least one detent and the at least one protrusion may provide an audible indication of tension adjustment as well.

Another embodiment of the invention comprises a tensioning system for adjusting the tension imparted to a cable tie in a cable tie tensioning and cut-off tool, the cut off tool including a housing and a cable tie gripping mechanism, the tensioning system having a rotatable tension adjustment knob coupled to a rotating cam; the rotating cam threadingly coupled to a fixed cam; the fixed cam coupled to the housing; a tension shaft having at least one tension biasing member coupled thereto, the tension shaft being attached to the fixed cam; and the tension shaft coupled to the cable tie gripping mechanism. A locking latch may be proved as described above to prevent desired movement of the tension adjustment knob all together or in desired increments. The increments may be relatively small or large as desired by the user. A similar calibration mechanism may also be provided to calibrate the force the cable tie tensioning and cut-off tool applies to a cable tie before cutting or severing the cable tie tail.

These and other objects, features and advantages of the present invention will be clearly understood through a consideration of the following detailed description.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1:
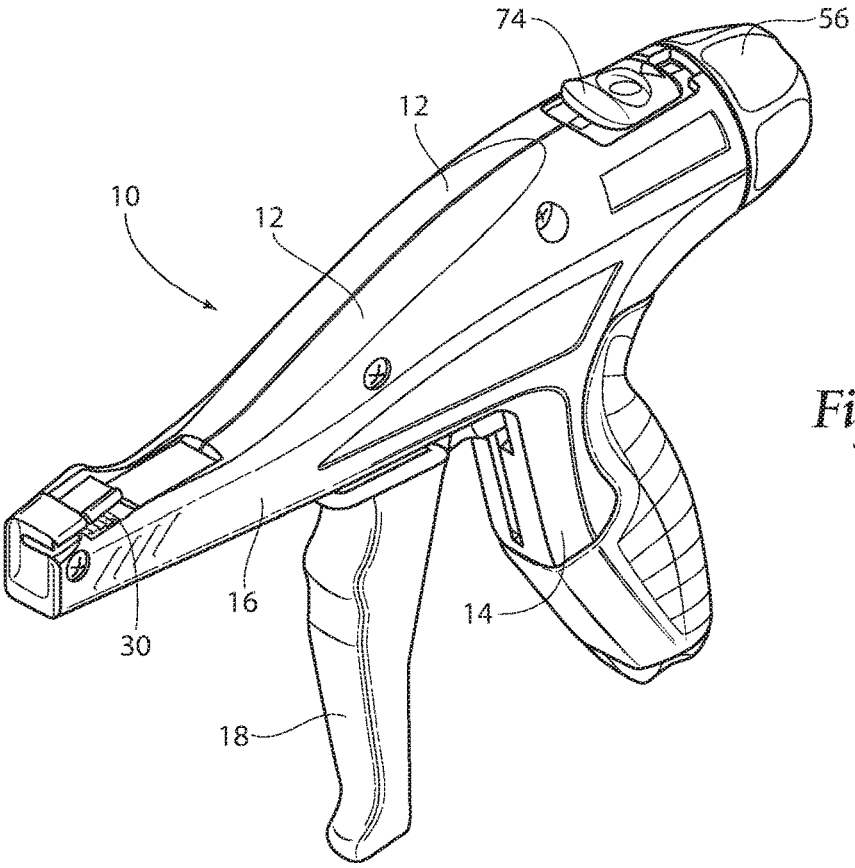
FIG. 1 is a perspective view of a cable tie tensioning and cut-off tool according to the present invention.
Figure 2:
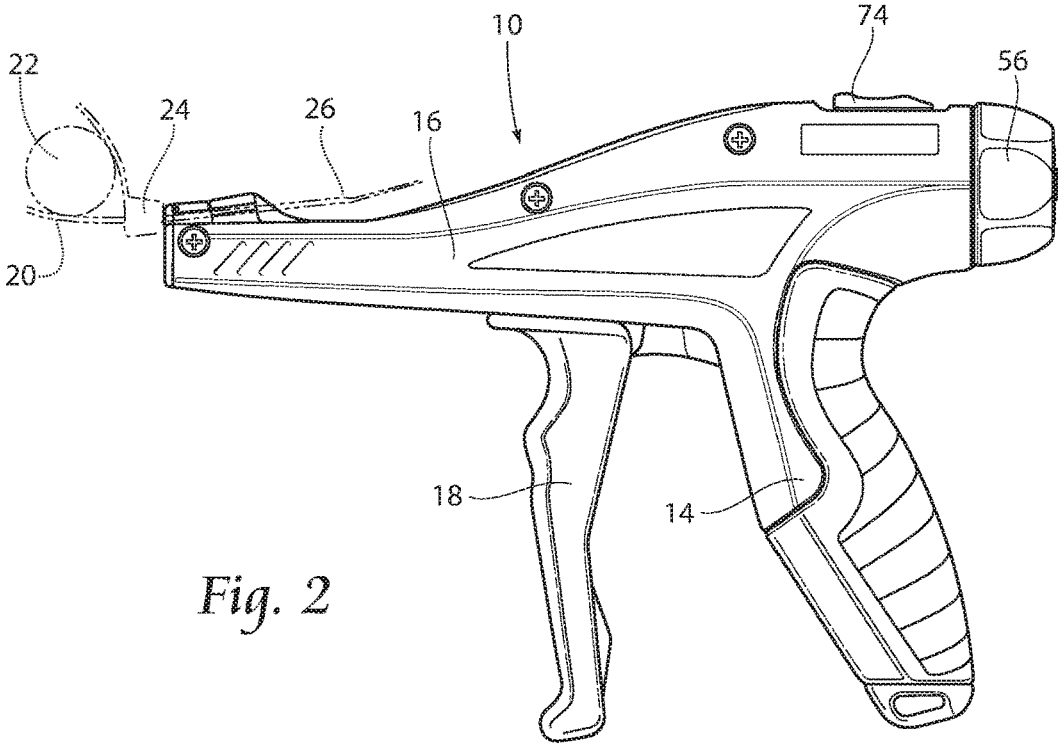
FIG. 2 is a left side view of the tool illustrated in FIG. 1.
Figure 3:
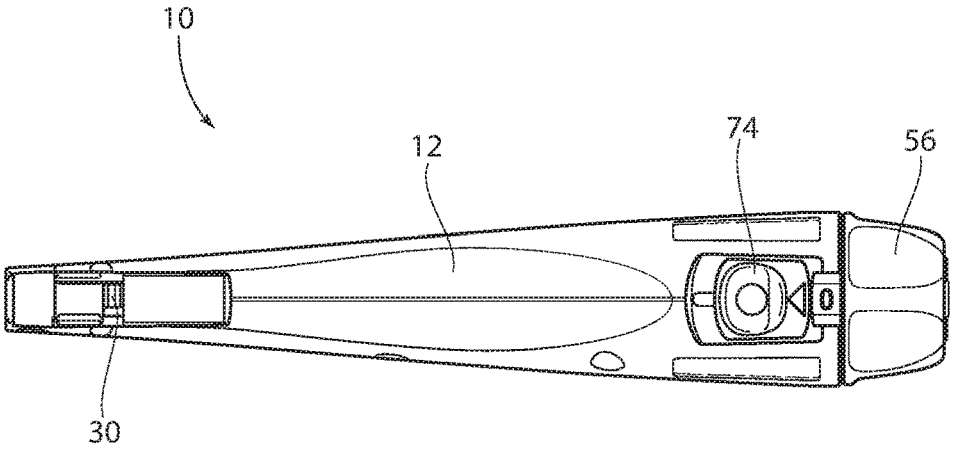
FIG. 3 is a top view of the tool illustrated in FIGS. 1 and 2.

Referring now to the drawings and in particular to FIGS. 1 and 2, an embodiment of the cable tie tensioning and cut-off tool 10 incorporating the principles of the present invention is shown as having a housing 12 in the shape of a pistol or gun and having a handle or grip portion 14, a barrel portion 16, and a trigger 18. The trigger 18 is located forwardly of the grip 14 and under the barrel portion 16 where it fits naturally in the hand of a user (not shown in these views). The tool 10 is typically used to install cable ties 20 (seen in phantom in FIG. 2) around elongate bundles 22, such as wire cable or the like. As mentioned earlier, cable ties are widely used in a variety of environments and applications, and may be used, for example, to bundle a plurality of elongate wires, cables, or other elongate articles 22, as is shown in FIG. 2. However, it is to be understood that the tool 10 of the present invention may be used to secure cable ties 20 in other applications, such as to secure elongate articles to rigid structures or used as hose clamps (not shown), by way of non-limiting example. As illustrated, a tie 20 includes a head portion 24 and a tie tail portion 26. The tool 10 grips the tail portion 26 of the tie 20 and pulls it through the head 24 until a predetermined tension is achieved. The tool 10 then locks the tension and automatically cuts off the excess tail portion 26 adjacent the head 24.

Figure 4:
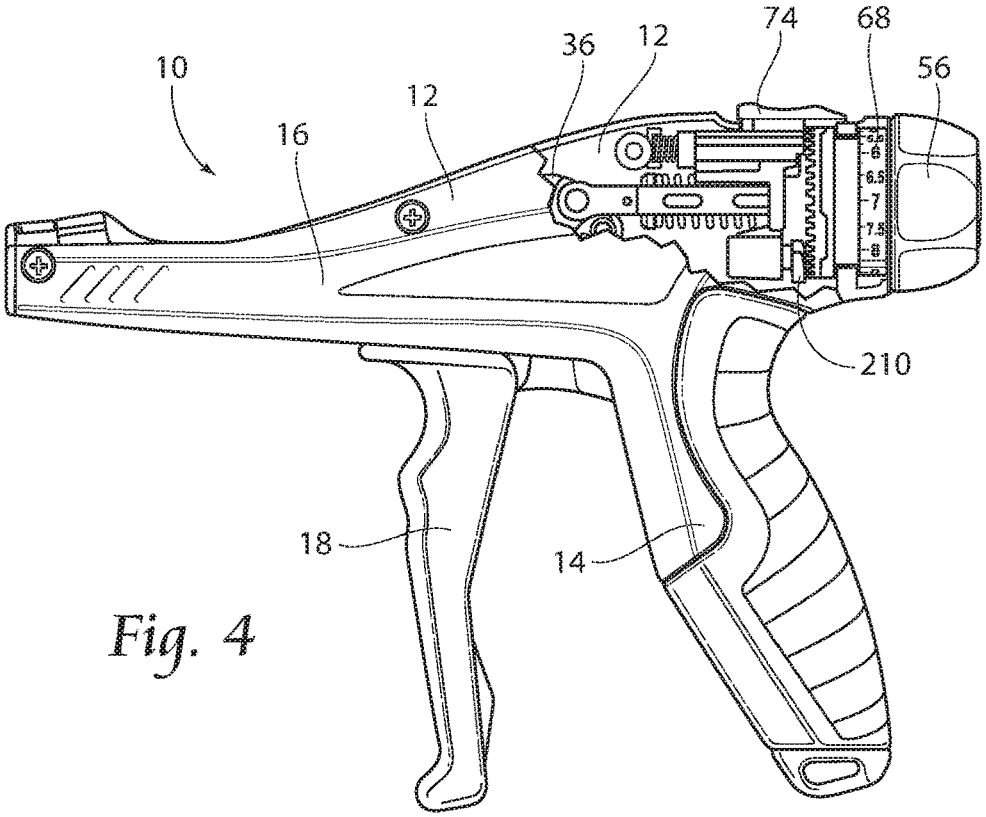
FIG. 4 is a view similar to that of FIG. 2, but with a portion of the housing removed and showing the tensioning mechanism.
Figure 5:
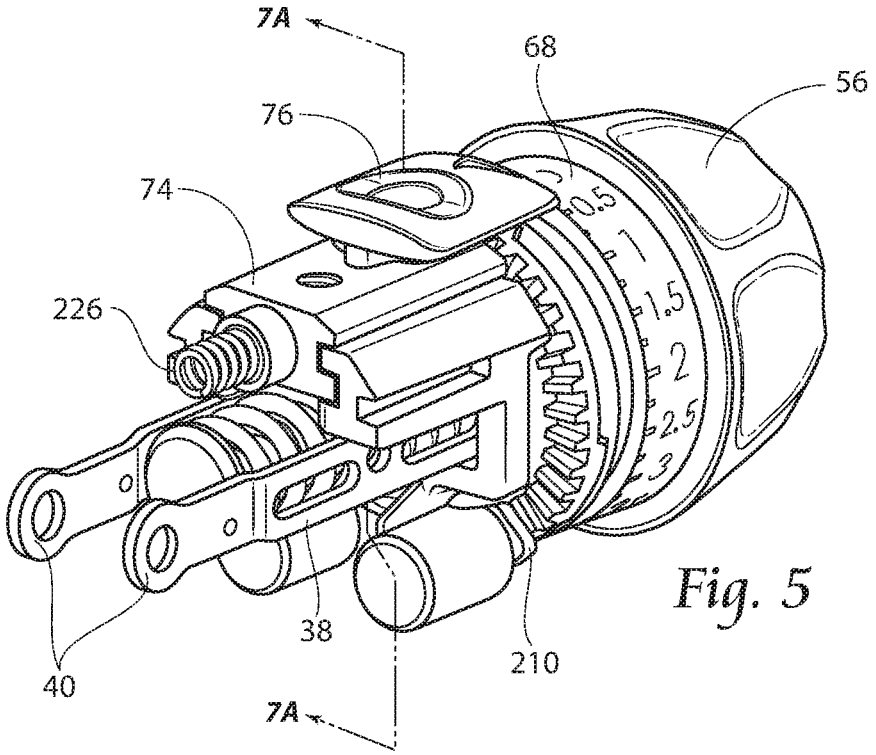
FIG. 5 is a top perspective view of a control knob on the tool shown in FIGS. 1-4 that provides tension adjustment.
Figure 6:
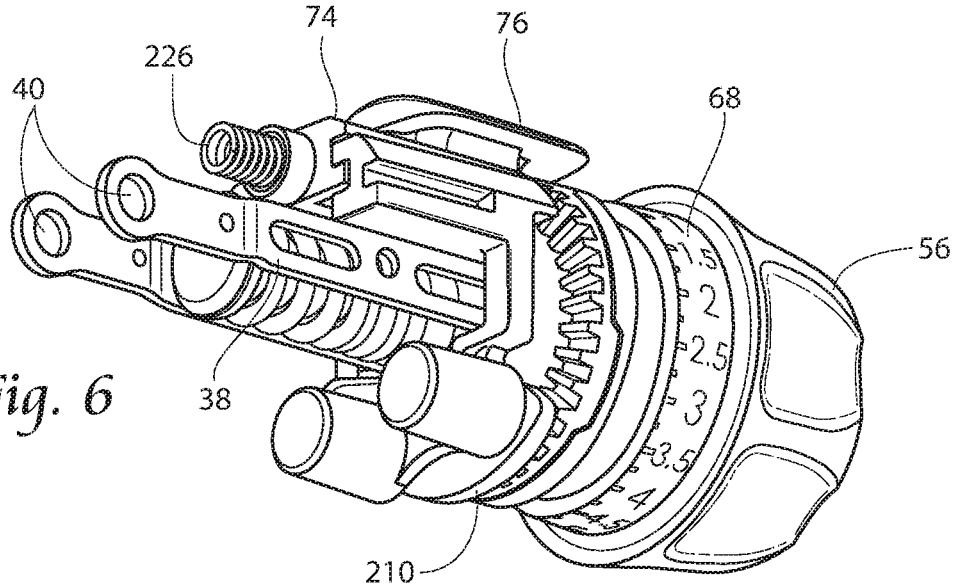
FIG. 6 is a bottom perspective view of the control knob illustrated in FIG. 5.

As seen in FIG. 4, a portion of one housing 12 sidewall has been cut away to show the opposite housing 12 sidewall and the internal parts and mechanism of the present tool 10. The tool 10 generally contains the usual components for a tool of this type, including a reciprocating tension mechanism, located in the barrel portion 16 of the tool 10 (not shown); the tension mechanism includes a gripping mechanism 30, for gripping the tail portion 26 of a tie 20, and a locking mechanism, for locking the tension mechanism at a predetermined tension prior to activating a cutoff mechanism. In operation, the tensioning mechanism pulls the gripped tail portion 26 rearwardly to a predetermined tension. Upon reaching the predetermined tension, the locking mechanism locks the tension. A cutoff mechanism (not shown), also located at the forward end of the barrel portion 16, activates to cause a blade member (not shown) to cut off the tie tail 26 closely adjacent the head portion 24. The predetermined tension is set or adjusted by way of a tension adjustment mechanism located at the rear of the tool 10, as will be discussed in detail.

Tension Adjustment System

The present tool 10 includes a novel tension adjustment mechanism, As will be seen, the tension control and adjustment mechanism of the present tool 10 functions to provide a controlled tension to the rear of the cutoff cam 36 (see FIG. 4). This, in turn, determines the point at which the cutoff cam 36 pivots to actuate the locking mechanism and the cutoff mechanism, to thereby cut off a tie tail 26.

The tension adjustment system of the present device is simple to use and eliminates the use of two knobs, as in known devices, through the use of an acme thread cam action and knob, as will be discussed. The system further provides both incremental tension settings and predetermined, widely spaced settings. The widely spaced settings allow the user to quickly change the tension settings in a one-handed operation. A tension control mechanism according to the present invention may be seen particularly in the views of FIGS. 5-8. As illustrated, the tension control mechanism includes a U-bracket 38 positioned horizontally, and slidably moveable, within the housing 12 at the rear end of the barrel portion 16 of the tool 10. The forward ends 40 of the U-bracket 38 are pivotally coupled to the rear end of the cutoff cam 36 by way of a tension pin (not shown) or other acceptable device, extending through the forward ends 40 of the U-bracket 38 and through a corresponding slot (not shown) in the cutoff cam 36. The rearward end of the U-bracket 38 is biased toward the rear of the housing 12 by means of the inner and outer tension springs, 46, 48 respectively. The tension springs 46, 48 are adjusted by a tension nut 52. A rotating cam 54 is coupled to a tension adjustment knob 56 by way of tessellated portions 58 which engage corresponding interlocking splines 60 in the adjustment knob 56. The rotating cam 54 further includes a threaded portion 62 adapted to threadingly engage the internal threaded portion 70 of fixed cam 64 and its housing 66. As the adjustment knob 56 is turned, the rotating cam 54 either draws the tension shaft 50 closer to the rear of the housing 12 or drives the tension shaft 50 farther from the rear of the housing 12 depending on the direction in which the adjustment knob 56 is turned. Accordingly, the tension applied by the U-bracket 38 to the cutoff cam 36 is increased as the adjustment knob 56 is turned so as to compress the tension springs 46, 48, and is decreased as the adjustment knob 56 is turned to decompress the tension springs 46, 48.

Figure 8:
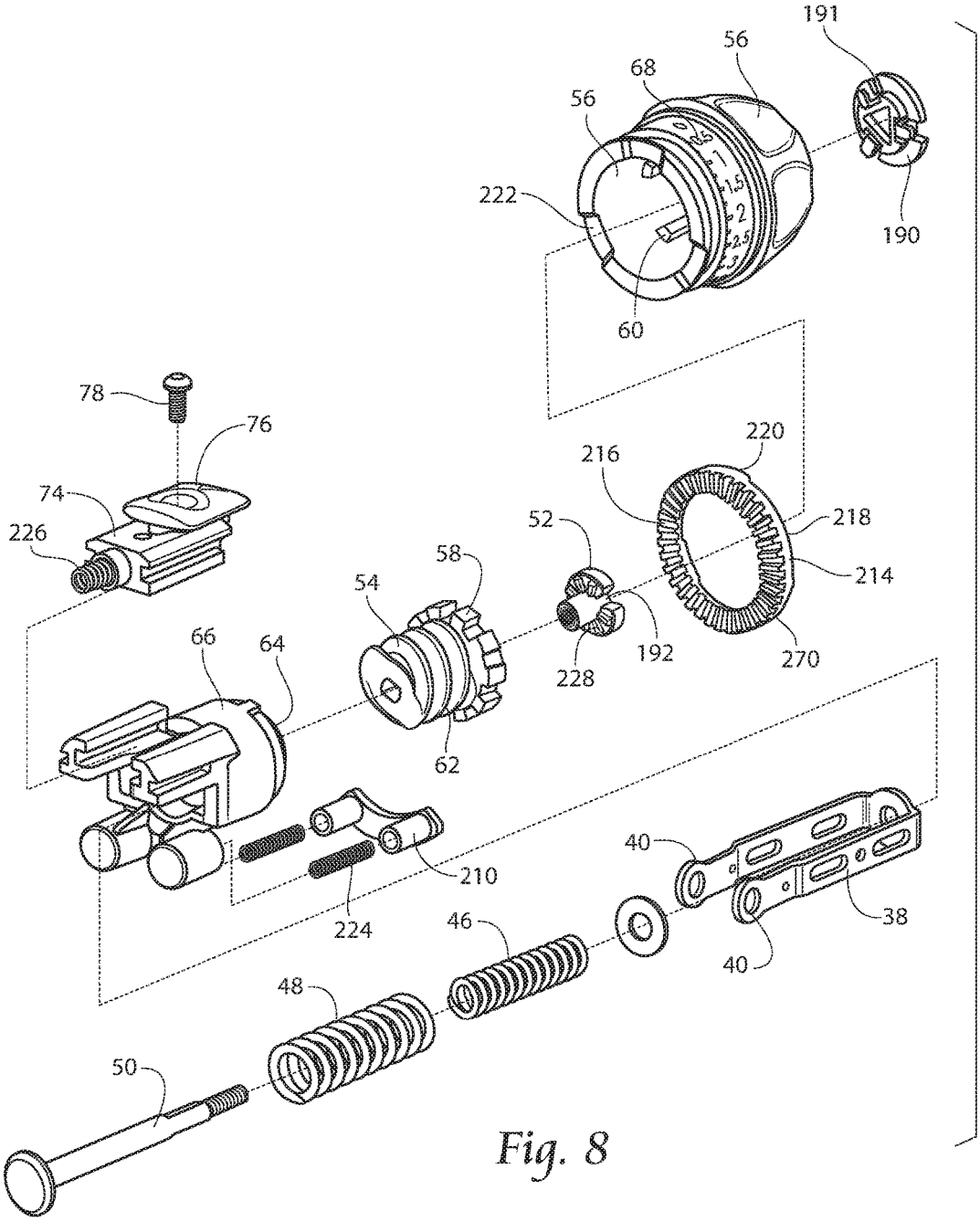
FIG. 8 is an exploded view of the control knob shown in FIGS. 5-7C.

With specific attention to FIG. 8, the tessellated portions 58 of the rotating cam 54 may be seen. The tessellated portions 58 mate with and slide on splines 60 located in the tension adjustment knob 56. This interrelationship allows the threaded portion 62 to rotate and move longitudinally along the splines 60, while the adjustment knob 56 remains stationary, thereby allowing the overall tool 10 length and tool ergonomics to remain constant throughout the adjustment range.

Figure 9:
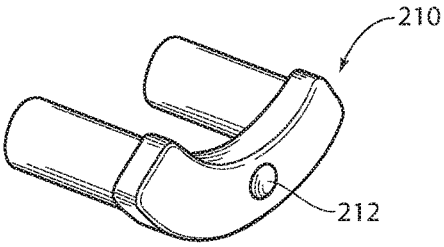
FIG. 9 is a perspective view of a hold back fin shown in FIG. 8.
Figure 13:
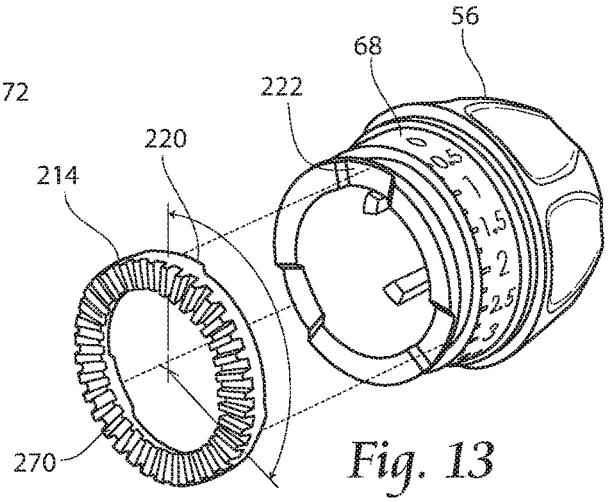
FIG. 13 is a perspective view of the ring and tensioning knob for use with the present device.
Figure 14:
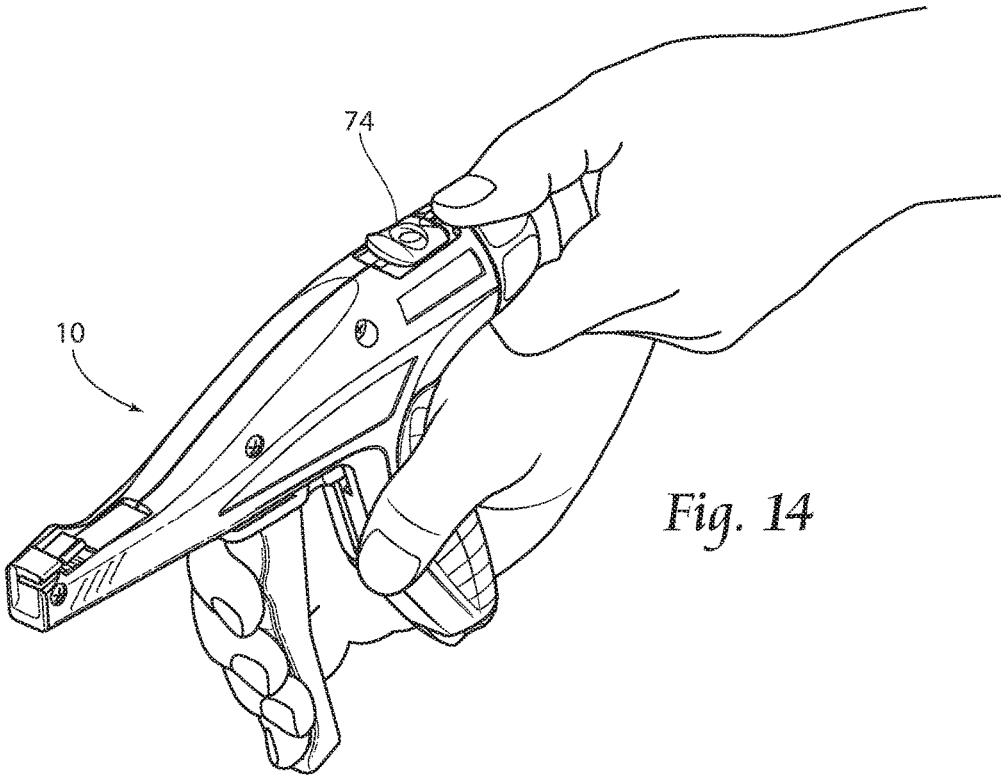
FIGS. 14-16 illustrate operation of the cable tie tensioning and cut-off tool shown in FIGS. 1-4.

With further attention to FIG. 8, incremental tension ranges may be seen to be provided by detents 270 on a ring member 214. Protrusions 212 on a pusher 210 (see also FIG. 9) ride in the detents 270. As shown, the ring member 214 includes a first side 216 which includes the mentioned detents 270, and a second side 218. Preferably, the adjustment knob 56 includes indicia 68 to designate selected tension settings. The indicia 68 correspond to the incremental tension ranges. The second side 218 includes a plurality of widely spaced cogs 220. The cogs 220 correspond to and engage with mating slots 222 on the adjustment knob 56 (see also FIG. 13). The cogs 220, in conjunction with the mating slots 222, allow the tension adjustment system to be adjusted to predetermined settings independent from the incremental tension settings provided by the previously mentioned detents 270. The cogs 220 and mating slots 222 allow the user to alternatively select tension settings that correspond to the cog 220 spacing. The tension settings that correspond to the cog 220 spacing are designed to provide a preset setting location for quick change of tension without requiring the user to manipulate the locking latch 74, as will be described. While the present drawings illustrate three spaced cogs 220, it is to be understood that the number and spacing of the cogs 220 may vary without departing from the present invention.

Figure 12:
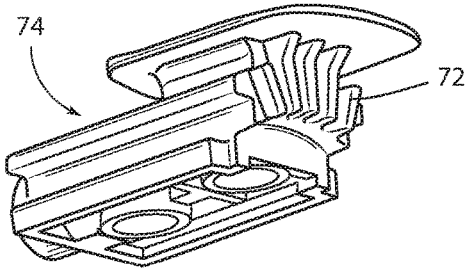
FIG. 12 is a bottom perspective view of a locking latch for use with the present device.
Figure 16:
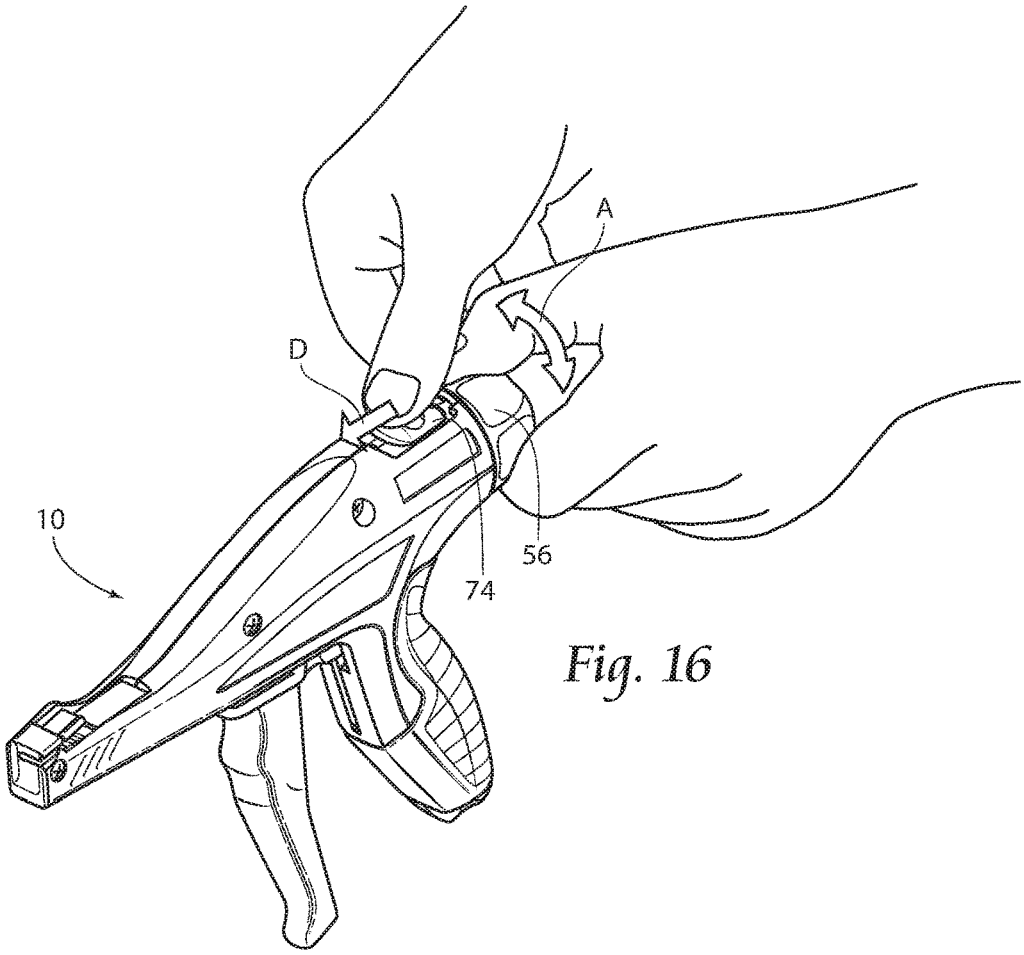
Figure 17:
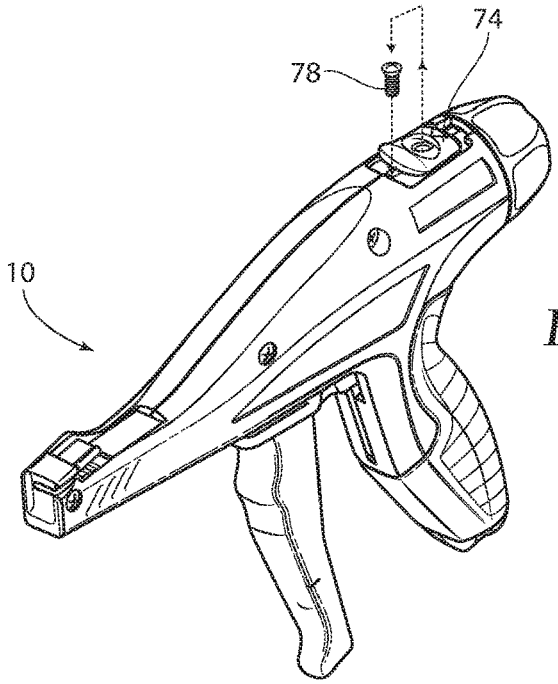
FIG. 17 is a view similar to that of FIGS. 14-16, but showing locking of the top latch.

As mentioned, the present tension adjustment system further includes capability to calibrate, hold and lock. A locking latch 74 is slidingly located on the housing 66 of the fixed cam 64. As best shown in FIG. 12, the locking latch 74 includes a plurality of teeth 72 that engage with detents 270 on ring member 214. As is seen particularly in the views of FIGS. 7A-8, the locking latch 74 includes a switch 76 and a locking pin 78, seen as a screw in these views. Incremental tension adjustment using the locking latch 74 is illustrated in FIGS. 16 and 7C. As viewed, to adjust tension, the hold switch 76 on the top of the tool 10 is moved in the direction of arrow D, to an unlocked position; the adjustment knob 56 is rotated in the direction of arrow A (see also FIG. 7C) to the desired tension setting; and the hold switch 76 is released to the lock position (see FIG. 7A). The precise tension setting is accomplished by rotating the adjustment knob 56 across the multiple discrete detent stops 270 on the ring 214. As is seen in FIG. 7C, as the adjustment knob 56 is rotated in the direction of arrows A, the detent stops 270 pass over the protrusions 212 on the pusher 210 to thereby bias the pusher spring 224 in the direction of arrow B. This action provides the user with both tactile and audible indications of the tension settings associated with the indicia 68. If desired, the locking latch 74 may be locked to prevent inadvertent tension changes by moving the locking pin 78 from its stowed position to a locked position (see FIG. 17).

Figure 7A:
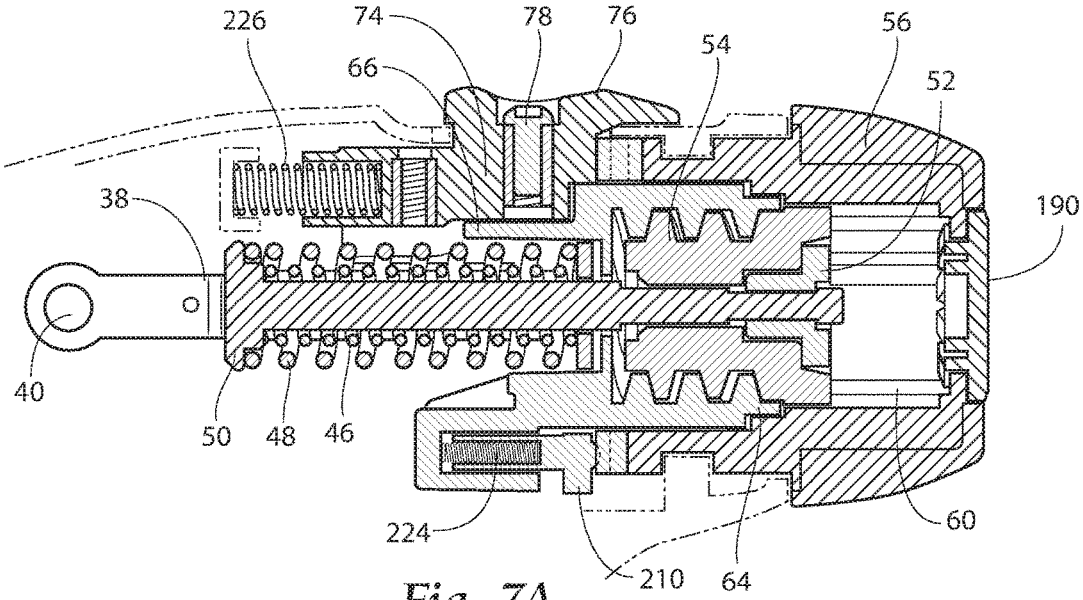
FIGS. 7A-7C are cross sectional views of the control knob illustrated in FIG. 5 taken along lines 7A-7A thereof, and showing further details of the form and function of the; control knob, operation of the control knob and showing movement of the associated parts.
Figure 7B:
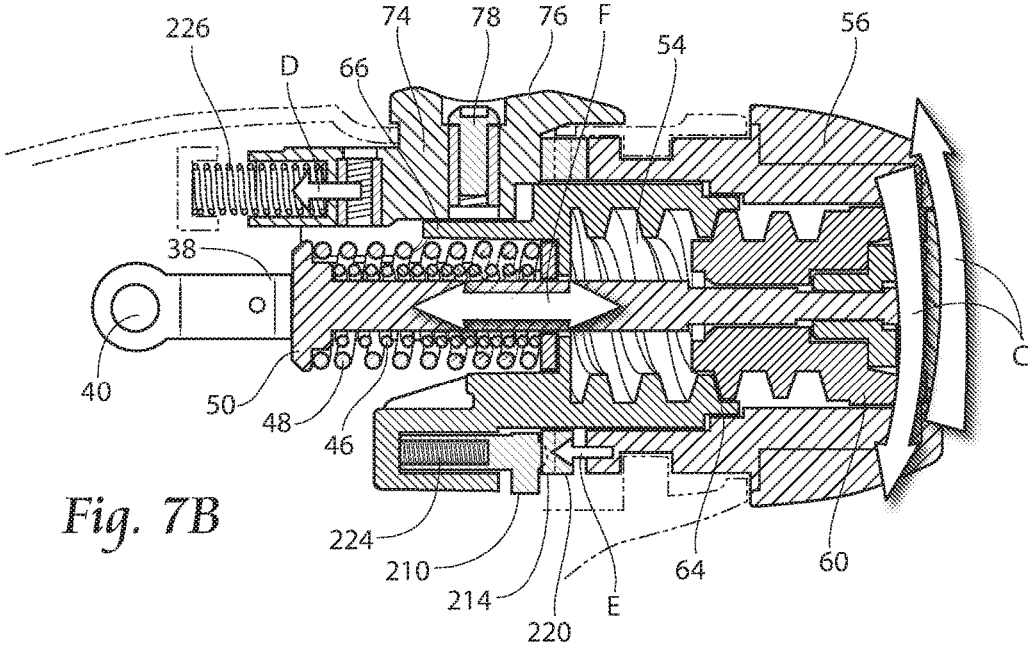
Figure 7C:
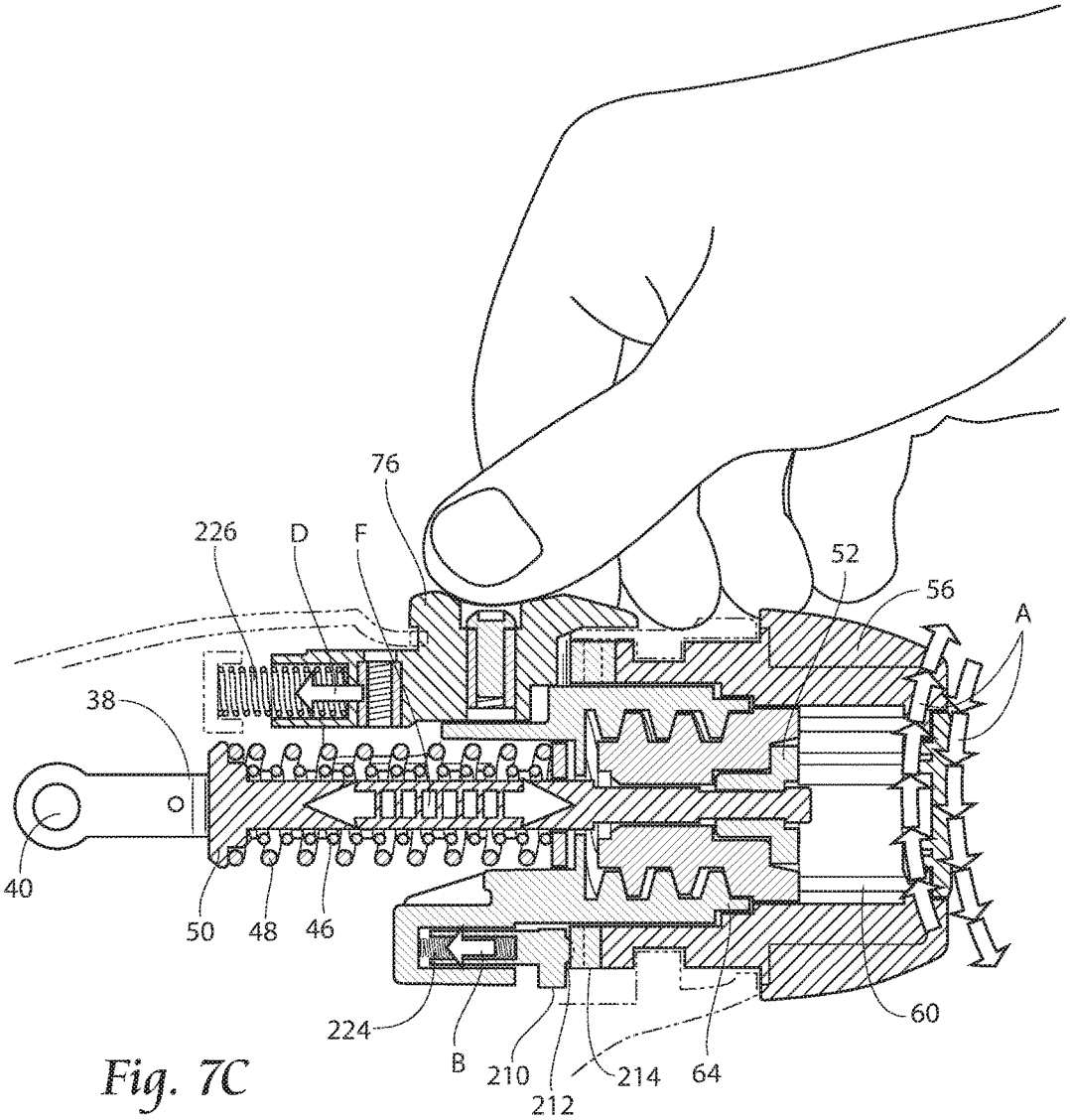
Figure 15:
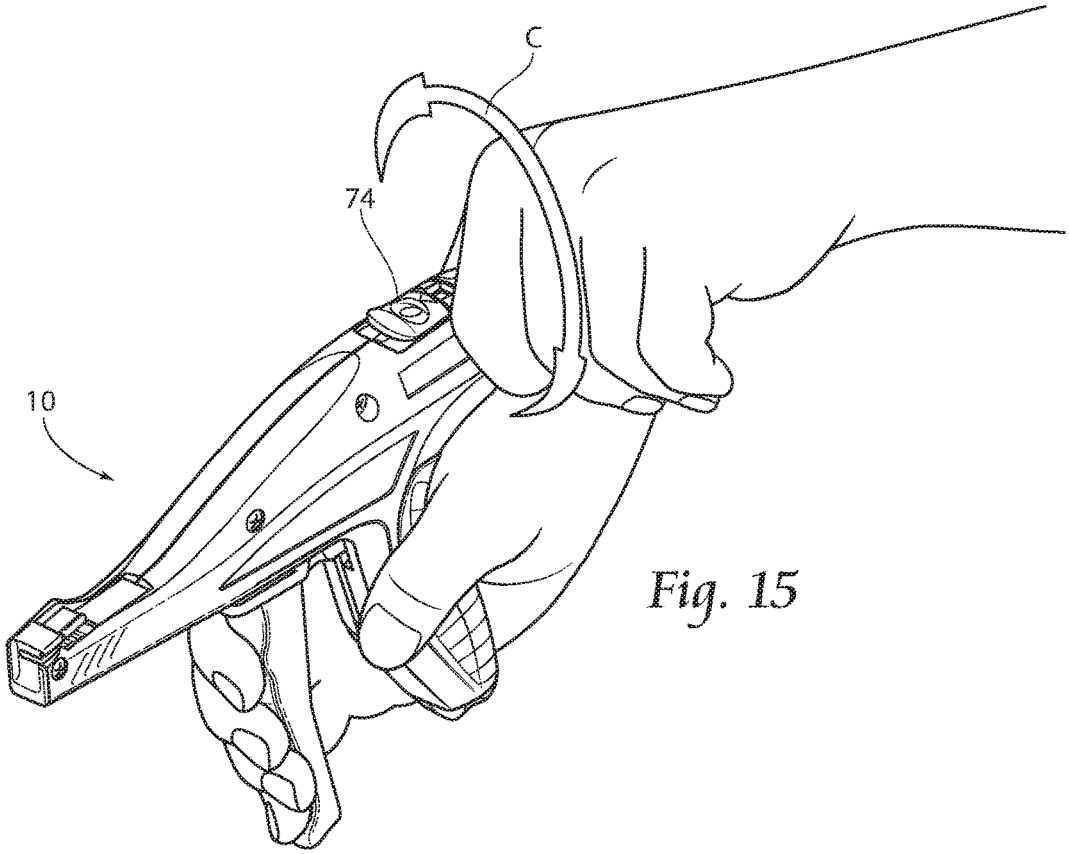

As seen in FIGS. 7B and 15, tension may be alternatively adjusted without the need to manipulate the locking latch 74. As shown, a user may rotate the adjustment knob 56 in the direction of arrow C without manipulating the locking latch 74. When a user rotates the adjustment knob 56 without manipulating the locking latch 74, the ring member 214 moves in the direction of arrow E and biases the pusher spring 224 and locking latch spring 226 in the direction of arrow D. The user continues to exert torque on the adjustment knob 56 to overcome the bias of the springs 224 and 226 while the ring member 214 continues movement in the direction of arrow E, thereby disengaging the slots 222 from the cogs 220 and allowing the adjustment knob 56 to rotate until the user reengages an adjacent cog 220. During adjustment, the slots 222 on tension adjustment knob 56 slip to ride over the second side 218 of the ring member 214, until the next desired cog 220 is selected thereby moving the tension shaft 50 in the direction of arrow F and changing the tension to correspond with the spaced cogs 220 on the ring member 214.

Calibration

The tension adjustment system may be calibrated at the point of manufacture or may be calibrated in the field. Calibration sets the base tension point from which the further tension adjustments, discussed previously, may be made. During calibration, a calibration tension tool 80 may be used.

Figure 10:
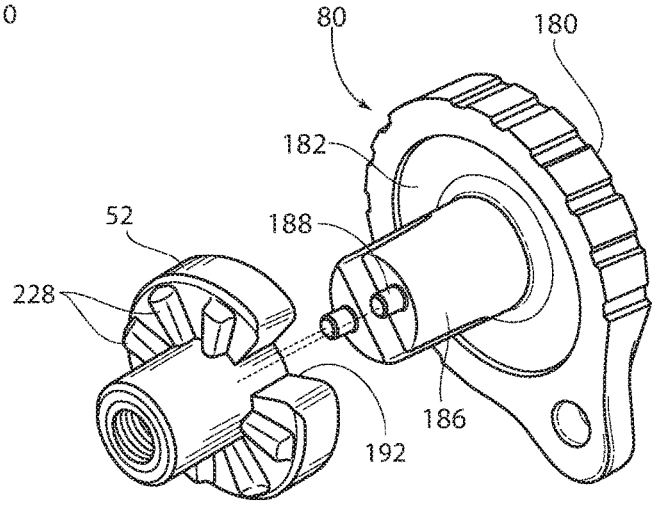
FIG. 10 is a perspective view of a calibration tool for use with the present device.
Figure 11:
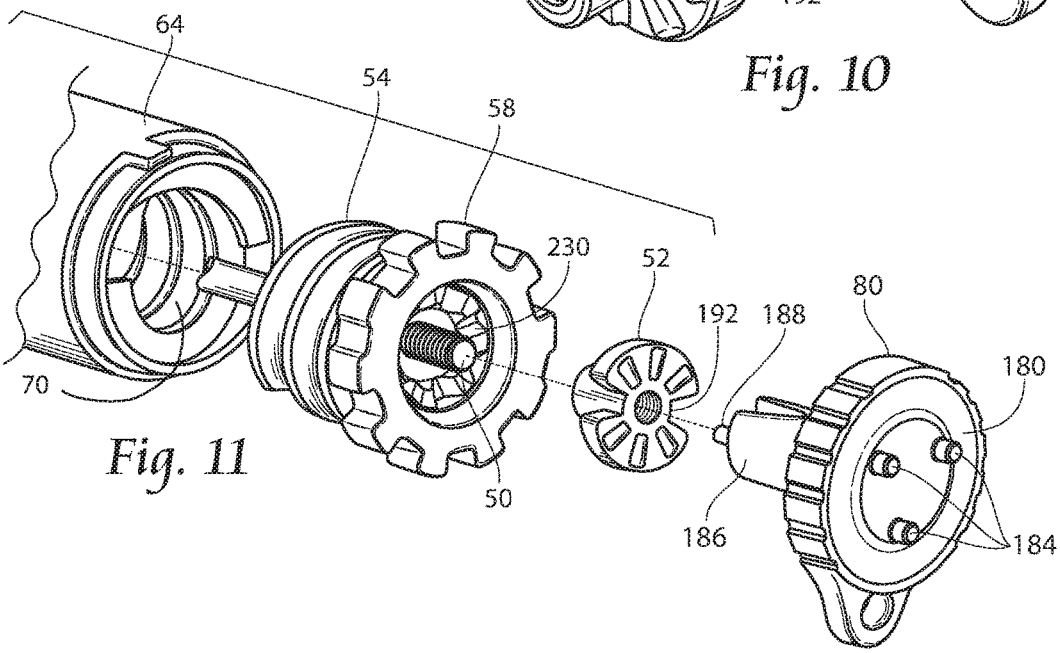
FIG. 11 is a fragmentary exploded view of the cams and calibration nut and showing engagement means.

With specific reference to FIG. 10, a calibration tension tool 80 for use with the present device 10 may be seen. As seen, the calibration tension tool 80 includes a first side 180 and a second side 182. As viewed, the first side 180 preferably includes a plurality of upstanding protuberances 184. A second side 182 of calibration tension tool 80 includes an upstanding, elongate key device 186. As shown, the key device 186 may further include at least one pin portion 188. The first side 180 of calibration tool 80 may be used to remove the calibration cap 190. The protuberances 184 engage corresponding detents 191 in the calibration cap 190 to allow the calibration tool 80 to twist off the calibration cap 190 when access is desired. When the calibration cap 190 is removed, and as seen in FIGS. 10 and 11, the key device 186 on the second side 182 of calibration tool 80 along with pin portions 188 engage the tension calibration nut 52 in corresponding slots 192, The calibration tool 80 is then rotated in a direction to thereby rotate the tension nut 52 to a predetermined tension force. It is to be noted that rotation of the tension nut 52 may be in clockwise or counterclockwise direction, depending on whether the user wishes to set calibration at a higher or lower set tension force. Moreover, the calibration nut 52 may include a plurality of upstanding ridges 228 that are adapted to engage corresponding grooves 230 in the housing 66 of rotating cam 54 and fixed cam 64 (see FIG. 11). The arrangement of cooperating ridges 228 and grooves 230 provides a secure interaction between the elements over time and thereby reduces undesired tension nut 52 rotation and resultant tension force change due to slippage caused by vibration or frequent adjustment.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

I claim:

1. A tensioning system for adjusting the tension imparted to a cable tie a cable tie tensioning and cut-off tool, the cut off tool including a housing and a cable tie gripping mechanism, the tensioning system comprising:

a tension adjustment knob having at least one slot formed thereon and at least one spline formed therein;

a ring member having at least one cog on a first side and at least one detent on a second side, the at least one cog being engageable with the at least one slot;

a rotating cam having an external thread and at least one tessellated portion formed thereon, the at least one tessellated portion being engageable with the at least one spline;

a fixed cam coupled to said housing and having an internal thread being engageable with the rotating cam external thread;

a tension shaft having a first end, the first end being coupled to the rotating cam; and at least one tension biasing member coupled to the shaft and to the gripping mechanism.

2. The tensioning system of claim 1 further including a locking latch coupled to the housing and having at least one tooth engageable with the at least one detent.

3. The tensioning system of claim 2 wherein, when engaged, the locking latch prevents a disengagement of the at least one tooth and the at least one detent.

4. The tensioning system of claim 1 further including a protrusion affixed to the fixed cam, the protrusion being engageable with the at least one detent formed on the ring member.

5. The tensioning system of claim 4 wherein the at least one detent and the at least one protrusion provide a tactile indication of tension adjustment.

6. The tensioning system of claim 4 wherein the at least one detent and the at least one protrusion provide an audible indication of tension adjustment.

7. The tensioning system of claim 1 further including a calibration mechanism, the calibration mechanism comprising:

a thread being formed on a first end of the tension shaft; and a calibration nut being located between the rotating cam and the tension adjustment knob, the nut including a threaded opening for receiving the first end of the tension shaft.

8. The tensioning system of claim 7 further including a calibration tool having a working end; and the calibration nut including at least one slot being formed therein whereby the calibration tool working end may be engaged with the at least one calibration nut slot.

9. The tensioning system of claim 7 whereby the tension adjustment knob has an opening and the tension calibration nut is accessible through said opening.

10. The tensioning system of claim 8 wherein the tension adjustment knob has an opening formed therein and further including a removable cap attachable to the opening.

11. The tensioning system of claim 8 wherein a plurality of ridges are formed on the calibration nut, the ridges being engageable with grooves formed on the rotating cam.

12. The tension system of claim 1 wherein the at least one tension biasing member comprises at least one spring.

13. The tensioning system of claim 1 wherein the at least one tension biasing member comprises a plurality of springs.

14. The tensioning system of claim 1 further including indicia formed on the tension adjustment knob, said indicia corresponding to incremental tension ranges and designated tension settings.

15. A tensioning system for adjusting the tension imparted to a cable tie in a cable tie tensioning and cut-off tool, the cut off tool including a housing and a cable tie gripping mechanism, the tensioning system comprising:

a rotatable tension adjustment knob coupled to a rotating cam;

the rotating cam threadingly coupled to a fixed cam;

the fixed cam coupled to the housing;

a tension shaft having at least one tension biasing member coupled thereto, the tension shaft being attached to the fixed cam; wherein the tension shaft is coupled to the cable tie gipping mechanism; and a calibration mechanism comprising:

a thread being formed on a first end of the tension shaft, and a calibration nut being located between the rotating cam and tension adjustment knob, the nut including a threaded opening for receiving the first end of the tension shaft.

16. The tensioning system of claim 15 wherein the at least one tension biasing member comprises at least one spring.

17. The tensioning system of claim 15 further including a locking latch coupled to said housing and being selectably engageable with said tension adjustment knob.

18. The tensioning system of claim 15 further including a calibration tool having a working end; and the calibration nut including at least one slot being formed therein whereby the calibration tool working end may be engaged with the at least one calibration nut slot.

19. The tensioning system of claim 15 wherein a plurality of ridges are formed on the calibration nut, the ridges being engageable with grooves formed on the rotating cam.

* * * * *